US007213726B2

(12) United States Patent
Rossignol

(10) Patent No.: US 7,213,726 B2
(45) Date of Patent: May 8, 2007

(54) SINGLE-DOSE COSMETIC SAMPLE DISPENSER

(75) Inventor: Eric Rossignol, Chalon sur Saone (FR)

(73) Assignee: Rexam Dispensing SMT (FR)

( * ) Notice: Subject to any disclaimer, the term of this patent is extended or adjusted under 35 U.S.C. 154(b) by 26 days.

(21) Appl. No.: 11/257,186

(22) Filed: Oct. 24, 2005

(65) Prior Publication Data

US 2006/0097012 A1 May 11, 2006

Related U.S. Application Data

(63) Continuation of application No. PCT/EP2004/004230, filed on Apr. 21, 2004.

(30) Foreign Application Priority Data

Apr. 23, 2003 (FR) ..... 03 04981

(51) Int. Cl.
*A45D 34/02* (2006.01)

(52) U.S. Cl. ..... 222/153.13; 222/320; 222/402.11; 222/541.6

(58) Field of Classification Search ..... 222/153.13, 222/402.11
See application file for complete search history.

(56) References Cited

U.S. PATENT DOCUMENTS

| | | | | |
|---|---|---|---|---|
| 5,085,347 A | | 2/1992 | Hayes et al. | 222/153 |
| 5,772,347 A | | 6/1998 | Gueret | 401/263 |
| 5,848,733 A | * | 12/1998 | Foster et al. | 222/153.13 |
| 5,975,370 A | * | 11/1999 | Durliat | 222/153.06 |
| 6,227,411 B1 | * | 5/2001 | Good | 222/153.13 |
| 6,352,181 B1 | * | 3/2002 | Eberhard et al. | 222/153.13 |
| 6,691,896 B2 | * | 2/2004 | Meshberg | 222/153.13 |

FOREIGN PATENT DOCUMENTS

| | | |
|---|---|---|
| DE | 3828496 | 3/1990 |
| FR | 2 826 245 | 12/2002 |

OTHER PUBLICATIONS

International Search Report (PCT, Jul. 19, 2004, 2 pages).

* cited by examiner

*Primary Examiner*—J. Casimer Jacyna
(74) *Attorney, Agent, or Firm*—St. Onge Steward Johnston & Reens LLC

(57) ABSTRACT

The invention concerns a fluid substance sample dispenser comprising a cylinder defining a chamber for receiving said substance and closed by a plunger adapted to slide inside said cylinder and by a cap, rotatably mobile between an open position and a closed position; said dispenser comprising locking means; said cap comprising a skirt adapted to be pressed against the wall of said cylinder, said skirt having a first radial slot designated to co-operate with a second radial slot provided in said cylinder in the open position such that said chamber projects outwards, and said locking means including a tubular member maintaining said cap in said closed position and locking it in translation, said tubular member having a cleavable portion.

10 Claims, 2 Drawing Sheets

SINGLE-DOSE COSMETIC SAMPLE DISPENSER

This application is a continuation of International Patent Application No. PCT/EP2004/004230 filed on Apr. 21, 2004, which designates the United States and claims priority of French Patent Application No. 0304981 filed on Apr. 23, 2003.

FIELD OF THE INVENTION

The present invention relates to a fluid sample dispenser, in particular but not exclusively for dispensing cosmetic substances.

BACKGROUND OF THE INVENTION

Known dispensers comprise a cylinder that defines a chamber serving to receive said fluid. The cylinder is closed at a first end by a piston suitable for sliding inside said cylinder and at a second end by a cap. The cap is mounted to move in rotation relative to the cylinder between an open position and a closed position. Said dispenser further comprises locking means in order to prevent the piston from being pushed into said cylinder accidentally, which could cause said fluid to be expelled from said chamber if the cap happens to be in an open position at that time.

Such a dispenser is described in particular in Document FR 2 826 245.

In that document, the second end of the cylinder has at least a top wall portion which is perpendicular to the axis of the cylinder and in which an orifice is provided that is situated offset from the axis of rotation of the cap, and the cap has a wall portion adapted to bear against said orifice for closing it off, said wall portion having a bore leading to the outside of said cap and suitable for co-operating with said orifice. Thus, said cap is adapted to be driven in rotation so as to cause the bore to coincide with said orifice for the purpose of extracting said fluid.

In addition, the cylinder is provided with a removable skirt forming the locking means, said skirt being extended around said piston to its base so as to prevent the piston from being pushed into the cylinder inadvertently.

However, those locking means do not make it possible either to prevent the cap from being driven into said open position, at least before the dispenser is used for the first time, or to prevent the piston from being pushed in completely, it being easy for the piston to be actuated under the skirt.

SUMMARY OF THE INVENTION

An object of the present invention is thus to provide a sample dispenser that makes it possible, prior to it being used for the first time, both to lock the cap in the closed position and also to prevent the piston from moving relative to said cylinder.

To this end, the present invention provides a fluid sample dispenser for dispensing fluids, in particular cosmetic fluids, said dispenser comprising a cylinder that defines a chamber which serves to receive said fluid and which is closed at a first end by a piston suitable for sliding inside said cylinder and at a second end by a cap that is mounted to move in rotation between an open position and a closed position, said dispenser further comprising locking means; said cap has a skirt adapted to bear against the wall of said cylinder, said skirt being provided with a first radial slot serving to co-operate with a second radial slot provided in said second end of said cylinder, in said open position so that said chamber is open to the outside; and said locking means comprise a tubular member adapted to hold said cap in said closed position and to prevent it from moving in translation relative to said piston, said tubular member having a break-off portion for releasing said cap from said tubular member.

Thus, an advantageous characteristic of the invention lies in the fact that, before the dispenser is used for the first time, said cap is held stationary relative to said piston by a tubular member having a portion that is suitable for being broken off. In this way, before said break-off portion has been removed, the cap and the piston cannot have been driven towards each other and the piston cannot have been pushed into the cylinder. It is thus possible to be absolutely sure that the dispenser has not already been used.

Preferably, said tubular member and said cylinder have means for preventing them from moving in rotation relative to each other, and said tubular member and said cap are prevented from moving in rotation relative to each other so as to prevent said cap from moving in rotation relative to said cylinder in said closed position. Thus, not only is the piston prevented from moving in translation relative to the cylinder and the fluid that it contains cannot have been ejected, but also said fluid has necessarily been protected in substantially airtight manner before said break-off portion is removed.

After the break-off portion has been removed, the cap and the piston are released from each other and the cap is suitable for being driven in rotation into an open position in which the two radial slots are disposed in register with each other. Then the cap being driven towards the piston makes it possible to force said piston into the chamber and to drive at least a portion of the liquid it contains out through the radial slots so that said liquid flows laterally out from the dispenser. The radial slots make it possible to shorten the path for the liquid between the chamber and the outside compared with the paths in prior art devices.

Advantageously, as explained in more detail below, the cap is provided with a spout making it possible to channel the liquid.

In a particularly advantageous embodiment of the invention, said tubular member has a body portion that is integral with or secured to said break-off portion, said piston being held so that it is prevented from moving in translation inside said body portion, spaced apart from the inside wall thereof so as to leave a cylindrical empty space between said piston and said inside wall, in which space said cylinder is suitable for being received. Thus, said cap being driven in translation towards said body portion causes said piston to move relative to and in said cylinder while said cylinder is driven inside said cylindrical empty space.

Thus, by means of this characteristic, not only is the piston, which penetrates into the cylinder, preserved from dust or from knocks that could adversely affect the leak-tightness between the piston and the cylinder, but also, during compression, the cylinder is inserted between the body portion and the piston. In this way, the body portion is adapted to be held in the hand while, with the thumb pressing on the cap, the cylinder is driven towards the piston which compresses the liquid of the chamber, the cylinder sliding under the body portion without hindrance for the operator.

In a particularly advantageous first embodiment, said first end of said cylinder has a collar provided with a radial groove and suitable for being driven inside said cylindrical empty space, and said body portion is provided with an internal longitudinal rib that is adapted to be engaged in said radial groove in order to form said means for preventing said cylinder from moving in rotation relative to said tubular member. Thus, by means of this characteristic, since the cylinder is constrained to rotate with the body portion which itself is adapted to be connected to the cap by said break-off portion, said cap is suitable for being held in the closed position relative to said cylinder. In addition, after said break-off portion has been removed, the cap is suitable for being driven in rotation by holding the body portion in a stationary position without the cylinder also being driven in rotation by the friction forces appearing between the cap and the cylinder.

In this first embodiment, and preferably, said body portion has internal retaining means against which said collar is adapted to come into abutment in order to prevent said cylinder from moving in translation relative to said piston in mutually opposite directions.

In this way, with the piston being held in translation in said body portion, and with said cylinder, by means of its collar, being held in translation relative to said body portion, said piston which closes the first end of the cylinder is suitable for being held in this position without it being possible for it to escape therefrom. As explained in more detail below, this configuration, which is obtained while the cylinder is being filled, and after the chamber has been closed in airtight manner, makes it possible to seal the dispenser and to avoid any untimely opening.

In a particularly advantageous second embodiment of the invention, that end of said piston which is opposite from said cylinder is extended by a concentric sleeve that surrounds said piston, the inside surface of said sleeve being spaced apart from the outside surface of said piston so as to form a tubular concentric space suitable for receiving said cylinder; and said sleeve is adapted to be received in a first cylindrical portion of said empty space, against said inside wall of said body portion, said concentric space coinciding with a second cylindrical portion of said empty space in which said cylinder is adapted to be driven.

As explained in more detail below, this characteristic offers advantages for assembly of the dispenser of the invention, and makes it possible to stiffen it.

Preferably, that end of said piston which is adapted to slide in said cylinder is provided with a flared circular sealing lip adapted to come into abutment against the inside wall of said cylinder. Thus, when the piston is driven inside the cylinder, the internal pressure of the chamber tends to press said lip against the inside wall of the cylinder, thereby increasing the sealing between the piston and the cylinder while the fluid is being ejected.

In another particularly advantageous embodiment of the invention, said second end of said cylinder has a portion that is of cross-section smaller than the cross-section of said cylinder so as to form an internal shoulder and said skirt serving to be bear against the inside wall of said cylinder is provided with a peripheral bead projecting from the surface of said skirt and adapted to bear against said shoulder to prevent said cap from moving in translation relative to said cylinder.

In this way, firstly the cap is prevented from moving in translation relative to the cylinder and secondly the cap is guided in rotation relative to the cylinder not only by the skirt against the inside wall of said second end portion but also by the bead which is bearing against the shoulder.

Thus, in this configuration and in a particularly advantageous embodiment, said peripheral bead is interrupted to form two stop free ends, and said internal shoulder has an abutment extending in the vicinity of the surface of said skirt between said two stop free ends in order to limit the stroke in rotation of said cap relative to said cylinder between said closed position in which one of the stop free ends is in abutment against one face of said abutment and said open position in which the other of said stop free ends is in abutment against the opposite face of said abutment.

Thus, by making provision for the bead to extend over three-quarters of the periphery of the skirt, two limit positions are obtained that are spaced apart by substantially one quarter of a turn, making it possible to close off said cylinder in airtight manner.

Very advantageously, said tubular member and its body portion provided with said internal longitudinal rib and said cap are adapted to be molded integrally in one piece and to be made of plastics materials, thereby making it possible to obtain a dispenser at a very advantageous cost.

Naturally, the piston and its concentric sleeve are also molded integrally in one piece as is the cylinder. In this way, with only three distinct parts that are easy to produce by molding, it is possible to make the dispenser of the invention.

BRIEF DESCRIPTION OF DRAWINGS

Other features and advantages of the invention appear from reading the following description of particular embodiments of the invention, given by way of non-limiting indication, with reference to the accompanying drawings, in which.

DETAILED DESCRIPTION OF THE INVENTION

Figure 1:
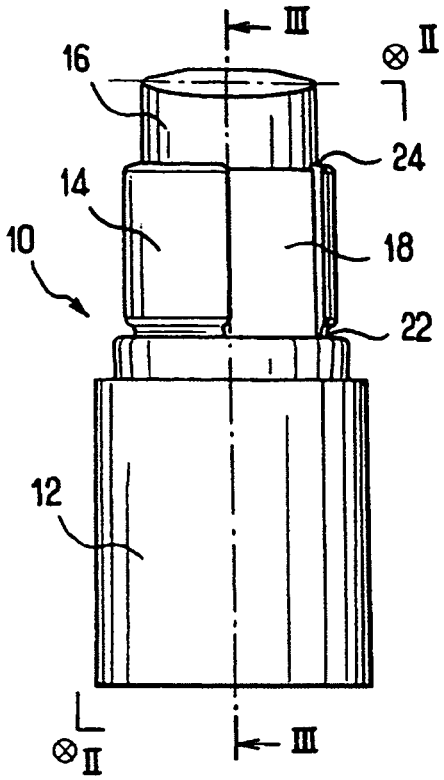
FIG. 1 is a diagrammatic back view of a dispenser of the invention in a first state.

FIG. 1 is an external back view of a dispenser of the invention in a locked first state indicating that it has not yet been actuated. Overall, said dispenser has a cylindrically symmetrical casing, and, as shown in FIG. 1, a tubular member 10 made up of a body portion 12 and of a break-off portion 14 which connects the body portion 12 to a cap 16 surrounding a cylinder 18 in part, in this example by extending over three-quarters of the circumference of the cylinder 18.

With reference to the section views of FIGS. 2 and 3, and to the view from below of FIG. 5, the component elements of the dispenser are described in detail below.

Figure 3:
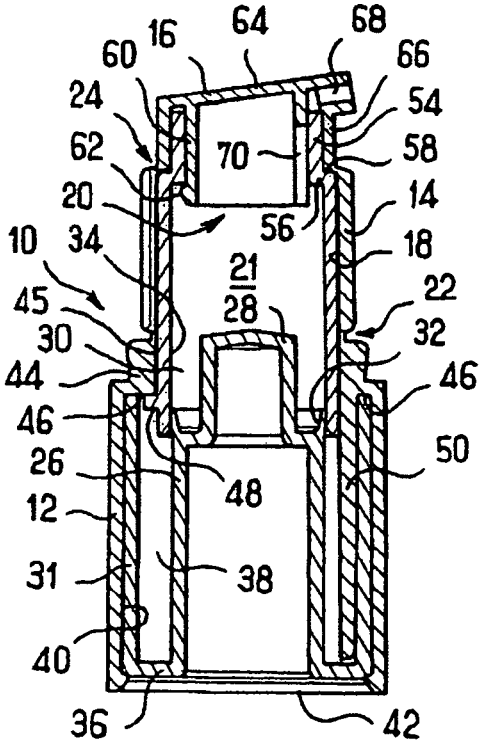
FIG. 3 is an axial section view of the dispenser shown in FIG. 1 on the plane III—III which is perpendicular to the plane of FIG. 1.

FIG. 3 shows the body portion 12 extended by the break-off portion 14, these portions together forming the tubular member 10, and the cap 16 overlies the break-off portion 14 and closes off a top end 20 of the cylinder 18. Said cylinder defines a chamber 21 that is suitable for containing a fluid, as explained in the description below.

The lid 16, the break-off portion 14 and the body portion 12 form one piece that has a first annular constriction 22 and a second annular constriction 24 defining the three parts;

said annular constrictions 22, 24 constituting thinner wall portions making it possible for the break-off portion 14 to be subsequently broken off and to be separated completely from the cap and from the body portion 12, as explained in more detail below.

In addition, the section view of FIG. 3 shows a piston-forming part 26 made up of a piston portion 28 that is engaged in part into a bottom end 30 of the chamber 21, and of a concentric sleeve 31 that extends said piston portion 28 while surrounding it; the part 26 is thus U-shaped in radial section.

The piston portion 28 closes off the bottom end 30 of the chamber in leaktight manner by means of a flared circular lip 32 that bears against the inside wall 34 of the chamber 21.

In addition, that end of said piston portion which is opposite from said cylinder 18 forms an end wall 36 to which the concentric 31 sleeve that surrounds said piston is connected. The concentric sleeve 31 is spaced apart from the piston portion 28 to form a concentric space 38 and it is applied against an inside wall 40 of the body portion 12, the end-wall 36 being flush with an open end 42 of the body portion 12.

The body portion 12 forms a circularly-symmetrical cylinder inside which said part 26 and the concentric sleeve 31 extend, between the open end 42 and a top end 44. Said top end 44 is narrowed so that it fits against the outside wall 45 of the cylinder 14 while forming an internal shoulder 46 against which the edge of the concentric sleeve 31 bears. Said narrowed top end 44 is extended by the break-off portion 14 from which it is distinct by means of the first annular constriction 22.

The cylinder 18 is prevented from moving in translation away from the piston portion 28, in the narrowed top end 44, by means of a projecting collar 48 which is situated in the vicinity of the bottom end 30 and which bears against the shoulder 46. Naturally, the diameter of the collar 48 is smaller than the diameter of the concentric sleeve 31, firstly so as to bear in full against the shoulder 46 while being adjacent to the edge of the concentric sleeve 31 and secondly so as to be driven in translation inside the concentric space 38 with the cylinder 18 without being subjected to friction stress, as explained below.

FIG. 3 shows a longitudinal rib 50 which extends from the shoulder 46 vertically below the outside wall 45 of the cylinder inside the concentric space 38 against the concentric sleeve 31 and down to the end wall 36.

Figure 5:
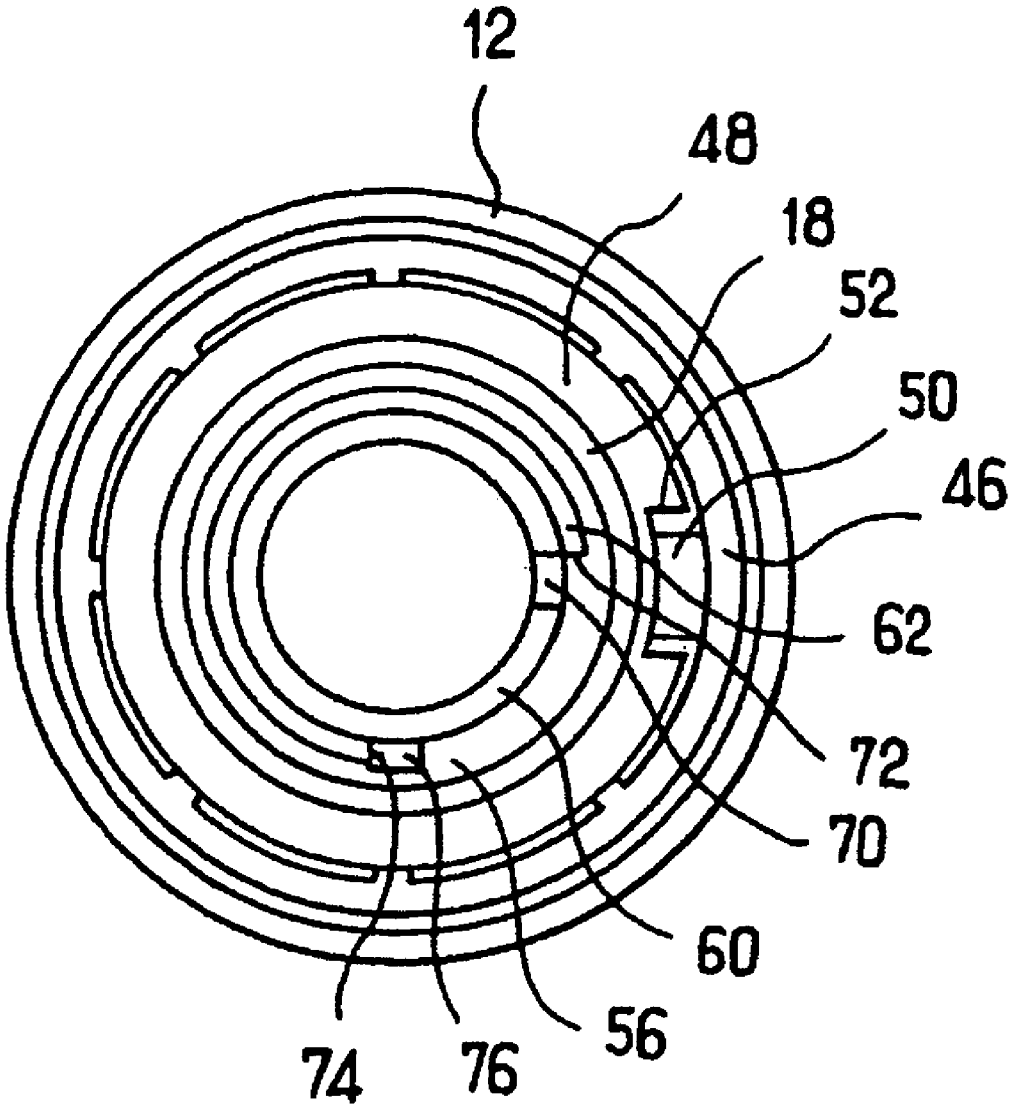
FIG. 5 is a particular diagrammatic view from below of the dispenser of the invention shown in FIG. 3.

FIG. 5, which shows a view from below of the dispenser shown in FIG. 3, without the part 26, also shows the longitudinal rib 50 and the shoulder 46 from which it extends freely. In addition, the collar 48 of the cylinder 18 is provided with a groove 52 in which the longitudinal rib 50 is engaged. In this way, the cylinder 18 is held in rotation and is thus indexed relative to the body portion 12. Conversely, the cylinder 18 is adapted to slide inside the concentric space 38, the longitudinal rib engaged in the groove 52 being designed to guide it in translation over the entire stroke over which it travels.

FIG. 3 shows that the top end 54 of the cylinder 18, opposite from the bottom end 30, forms a setback relative to the cylinder 18 defining an internal shoulder 56 and an external shoulder 58. The cap 16 has an inner skirt 60 adapted to bear against the inside wall of the top end 54, the free edge of the inner skirt having a projecting peripheral bead 62 that bears against the shoulder 56 serving to prevent the cap 16 from moving in translation relative to the cylinder 18.

In addition, the cap 16 has a top wall 64 to which the inner skirt 60 is connected, and which extends radially around the inner skirt beyond the free edge of the top end 54 of the cylinder 18. An outer skirt 66, concentric with the inner skirt 60, extends from the top wall 64 against the outside wall of the top end 54 to the external shoulder 58.

It is at the external shoulder 58 that the break-off portion 14 and the outer skirt 66 delimited by the second annular constriction 24 are interconnected.

Figure 4:
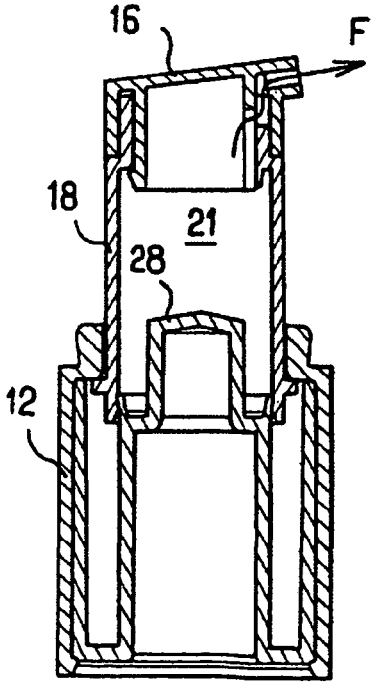
FIG. 4 is an axial section view of the dispenser of the invention in a second state.

In addition, the space situated between the two skirts, namely between the inner skirt 60 and the outer skirt 66, forms a portion of a path opening out at the top end 68 of the cap 16, forming a dispensing spout and that is described in detail with reference to FIG. 4.

As shown in FIG. 3, the top end 54 extends inside said space situated between the two skirts, and it closes off a first radial slot 70 shown in section.

FIG. 5 also shows the radial slot 70 provided in the inner skirt 60, and the peripheral bead 62 that extends around three-quarters of the periphery of the edge of the inner skirt while forming two stop free ends 72, 74. The internal shoulder 56 presents an abutment 76 which extends in alignment with the inside wall of the inner skirt 54 towards the bottom end 30 of the chamber 21, against the two opposite faces of which the two stop free ends 72, 74 are suitable for coming respectively into abutment. Naturally, this is possible insofar as the cap 16 is movable in rotation relative to the cylinder 16 as explained below.

Figure 2:
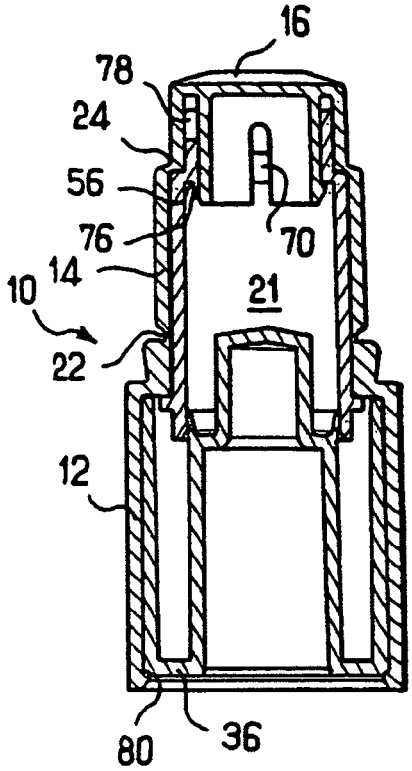
FIG. 2 is a diagrammatic axial section view of the dispenser shown in FIG. 1 on the plane II—II which is parallel to the plane of FIG. 1.

FIG. 2 shows the dispenser of the invention in axial section, offset by 90° in rotation relative to the view in FIG. 3, counterclockwise as seen from above.

FIG. 2 shows the cap 16 whose dispensing spout is facing backwards, and the inner skirt 60 in which the radial slot 70 is provided. In addition, FIG. 2 also shows the abutment 76 projecting from the shoulder 56.

FIG. 2 also shows a second radial slot 78 which is provided in the top end 54 of the cylinder 18 starting from its free edge. The second radial slot is completely closed off by the walls of the two skirts, namely the inner skirt 60 and the outer skirt 66; and it can be observed that the radial slots 70, 78 are offset by 90° relative to each other.

Thus, the top end 54 of the cylinder 18 is closed off in substantially leaktight manner by the cap 16.

Advantageously, the body portion 12, the break-off portion 14, and the cap 16 are molded integrally in one piece and of a plastics material, and the cylinder 18 is then engaged into the tubular member 10, the top end 54 being fitted into the cap 16 as shown in FIG. 2.

The chamber 21 defined by the cylinder 16 is then suitable for being filled with a fluid, e.g. a cosmetic fluid, and then closed again at its bottom end 30 by means of the piston portion 28, by engaging the part 26 into the body portion 12 from the open end 42. The part 26 is held in a stationary position in the body portion 12 by means of an internal peripheral bead 80 surrounding the open end 42 and against which the end-wall 36 comes into abutment.

In this way, the resulting dispenser is suitable for being used.

For the purpose of using the dispenser, firstly, the break-off portion 14 that surrounds the cylinder 18 in part as shown in FIG. 1 is broken off. This operation can be performed merely by pulling on one of its free ends and by unrolling it, thereby causing tears to occur at the annular constrictions 22, 24.

In this way, the cap 16 is free relative to the body portion 12 and is thus free to rotate partially relative to the cylinder 18. The rotation of the cap 16 is limited by the abutment 76 and the stop free ends 72, 74. In FIG. 5, the stop free end 74 is in abutment against the abutment 76 in a closed position as shown in FIG. 3. Starting from this position shown in FIG. 3, and considering that the break-off portion 14 has been removed, the cap 16 is held in a stationary position, and the body portion 12 is moved in rotation through 90° counterclockwise as seen from below, thereby driving the cylinder 18 by means of the longitudinal rib 50 co-operating with the groove 52 in the collar 48, and positioning the second radial slot 78 in register with the first radial slot 70. The dispenser is then in the state shown in FIG. 4, in which firstly the cap 16 is free from the body portion 12 and thus from the piston portion 28, and secondly a path F has been formed between the chamber 21 and the outside of the dispenser.

In this way, as soon as stress is exerted on the cap 16 towards the body portion 12, the cylinder 18 tends to penetrate into the concentric space 28 and simultaneously the piston portion 28 tends to penetrate into the chamber 21, thereby expelling the fluid it contains through the path F.

What is claimed is:

1. A fluid sample dispenser for dispensing fluids, in particular cosmetic fluids, said dispenser comprising a cylinder that defines a chamber which serves to receive said fluid and which is closed at a first end by a piston suitable for sliding inside said cylinder and at a second end by a cap that is mounted to move in rotation between an open position and a closed position, said dispenser further comprising locking means;

said dispenser being characterized in that said cap has a skirt adapted to bear against the wall of said cylinder, said skirt being provided with a first radial slot serving to co-operate with a second radial slot provided in said second end of said cylinder, in said open position so that said chamber is open to the outside;

and in that said locking means comprise a tubular member adapted to hold said cap in said closed position and to prevent it from moving in translation relative to said piston, said tubular member having a break-off portion for releasing said cap from said tubular member.

2. A sample dispenser according to claim 1, characterized in that said tubular member and said cylinder have means for preventing them from moving in rotation relative to each other, and in that said tubular member and said cap are prevented from moving in rotation relative to each other so as to prevent said cap from moving in rotation relative to said cylinder in said closed position.

3. A sample dispenser according to claim 1, characterized in that said tubular member has a body portion that is integral with or secured to said break-off portion, said piston being held so that it is prevented from moving in translation inside said body portion, spaced apart from the inside wall thereof so as to leave a cylindrical empty space between said piston and said inside wall, in which space said cylinder is suitable for being received.

4. A sample dispenser according to claim 2, characterized in that said first end of said cylinder has a collar provided with a radial groove and suitable for being driven inside said cylindrical empty space, and in that said body portion is provided with an internal longitudinal rib that is adapted to be engaged in said radial groove in order to form said means for preventing said cylinder from moving in rotation relative to said tubular member.

5. A sample dispenser according to claim 4, characterized in that said body portion has internal retaining means against which said collar is adapted to come into abutment in order to prevent said cylinder from moving in translation relative to said piston in mutually opposite directions.

6. A sample dispenser according to claim 3, characterized in that that end of said piston which is opposite from said cylinder is extended by a concentric sleeve that surrounds said piston, the inside surface of said sleeve being spaced apart from the outside surface of said piston so as to form a tubular concentric space suitable for receiving said cylinder;

and in that said sleeve is adapted to be received in a first cylindrical portion of said empty space, against said inside wall of said body portion, said concentric space coinciding with a second cylindrical portion of said empty space in which said cylinder is adapted to be driven.

7. A sample dispenser according to claim 1, characterized in that that end of said piston which is adapted to slide in said cylinder is provided with a flared circular sealing lip adapted to come into abutment against the inside wall of said cylinder.

8. A sample dispenser according to claim 1, characterized in that said second end of said cylinder has a portion that is of cross-section smaller than the cross-section of said cylinder so as to form an internal shoulder and in that said skirt serving to be bear against the inside wall of said cylinder is provided with a peripheral bead projecting from the surface of said skirt and adapted to bear against said shoulder to prevent said cap from moving in translation relative to said cylinder.

9. A sample dispenser according to claim 8, characterized in that said peripheral bead is interrupted to form two stop free ends, and in that said internal shoulder has an abutment extending in the vicinity of the surface of said skirt between said two stop free ends in order to limit the stroke in rotation of said cap relative to said cylinder between said closed position in which one of the stop free ends is in abutment against one face of said abutment and said open position in which the other of said stop free ends is in abutment against the opposite face of said abutment.

10. A sample dispenser according to claim 3, characterized in that said tubular member and said cap are adapted to be molded integrally in one piece and to be made of plastics materials.

* * * * *